US011261835B2

(12) United States Patent
Iwa et al.

(10) Patent No.: US 11,261,835 B2
(45) Date of Patent: Mar. 1, 2022

(54) DAMPER DEVICE

(71) Applicants: EAGLE INDUSTRY CO., LTD., Tokyo (JP); DENSO CORPORATION, Aichi (JP)

(72) Inventors: Toshiaki Iwa, Tokyo (JP); Yoshihiro Ogawa, Tokyo (JP); Yusuke Sato, Tokyo (JP); Tatsumi Oguri, Aichi (JP); Yusuke Kondo, Aichi (JP); Keigo Ohata, Aichi (JP)

(73) Assignees: EAGLE INDUSTRY CO., LTD.; DENSO CORPORATION

( * ) Notice: Subject to any disclaimer, the term of this patent is extended or adjusted under 35 U.S.C. 154(b) by 0 days.

(21) Appl. No.: 17/052,168

(22) PCT Filed: May 17, 2019

(86) PCT No.: PCT/JP2019/019615
§ 371 (c)(1),
(2) Date: Oct. 30, 2020

(87) PCT Pub. No.: WO2019/221258
PCT Pub. Date: Nov. 21, 2019

(65) Prior Publication Data

US 2021/0231088 A1 Jul. 29, 2021

(30) Foreign Application Priority Data

May 18, 2018 (JP) ..... JP2018-096184

(51) Int. Cl.
*F02M 55/04* (2006.01)
*F02M 59/44* (2006.01)

(52) U.S. Cl.
CPC ..... *F02M 55/04* (2013.01); *F02M 59/44* (2013.01)

(58) Field of Classification Search
CPC ..... F02M 2200/315; F02M 37/0041; F02M 55/04; F02M 59/44; F04B 11/00; F04B 11/0008; F04B 11/0016; F04B 11/0033
(Continued)

(56) References Cited

U.S. PATENT DOCUMENTS 3,020,928 A 2/1962 William ..... 138/30
4,728,085 A 3/1988 Bebermeier ..... 267/122
(Continued)

FOREIGN PATENT DOCUMENTS

CN 1219993 6/1999 ..... F01B 19/00
CN 103097716 5/2013 ..... F02M 59/44
(Continued)

OTHER PUBLICATIONS

U.S. Appl. No. 17/048,568, filed Oct. 16, 2020, Sato et al.
(Continued)

*Primary Examiner* — John M Zaleskas
(74) *Attorney, Agent, or Firm* — Hayes Soloway P.C.

(57) ABSTRACT

A damper device arranged in a housing space formed between a device main body and a cover member includes a pair of damper bodies each having a plate and a diaphragm and having an enclosed space sealed with gas. A biasing device is provided between the pair of damper bodies arranged facing each other and configured to bias the damper bodies from one side of the device main body and the cover member to the other side of the device main body and the cover member, stay members each extending from an outer peripheral edge portion of each of the damper bodies and brought into contact with other side, and a frame member arranged on one side of the device main body and the cover member and having a stopper portion configured to restrict movement of the damper bodies in the direction of the other side.

15 Claims, 6 Drawing Sheets

(58) Field of Classification Search
USPC ..... 417/540
See application file for complete search history.

(56) References Cited

U.S. PATENT DOCUMENTS

| | | | | |
|---|---|---|---|---|
| 5,743,170 | A | 4/1998 | Pascual et al. | 92/103 |
| 7,004,733 | B2 | 2/2006 | Schepp | B60T 8/4031 |
| 8,366,421 | B2 | 2/2013 | Munakata | 417/540 |
| 8,562,315 | B2 | 10/2013 | Inoue | 417/540 |
| 8,727,752 | B2 | 5/2014 | Lucas | 417/541 |
| 8,757,212 | B2 | 6/2014 | Bartsch | 138/30 |
| 8,955,550 | B2 | 2/2015 | Oikawa | 138/30 |
| 9,057,348 | B2 | 2/2015 | Usui | F02M 55/04 |
| 9,803,600 | B2 | 10/2017 | Nah | F02M 37/0041 |
| 9,828,988 | B2 | 11/2017 | Koehler | F02M 59/44 |
| 10,480,466 | B2 | 11/2019 | Tomitsuka et al. | F02M 37/0041 |
| 10,480,704 | B2 | 11/2019 | Yoshida | F02M 55/00 |
| 10,544,768 | B2 | 1/2020 | Kashiwagi | F02M 59/44 |
| 10,718,296 | B2 | 6/2020 | Hayatani et al. | |
| 10,753,331 | B2 | 8/2020 | Iwa | F16F 1/048 |
| 2002/0153209 | A1 | 10/2002 | Nagy | F16F 9/04 |
| 2003/0164161 | A1 | 9/2003 | Usui | F02M 59/366 |
| 2005/0019188 | A1* | 1/2005 | Usui | F02M 59/366 417/540 |
| 2006/0071381 | A1 | 4/2006 | Hatakeyama | 267/140.13 |
| 2006/0272144 | A1 | 12/2006 | Matsuki | B23K 26/125 |
| 2007/0079810 | A1* | 4/2007 | Usui | F02M 63/028 123/467 |
| 2008/0175735 | A1* | 7/2008 | Lucas | F02M 37/0041 417/540 |
| 2008/0289713 | A1 | 11/2008 | Munakata et al. | 138/26 |
| 2009/0288639 | A1 | 11/2009 | Usui et al. | 123/457 |
| 2010/0209274 | A1* | 8/2010 | Oikawa | F04B 53/004 417/540 |
| 2010/0215529 | A1* | 8/2010 | Inoue | F04B 53/002 417/540 |
| 2011/0103985 | A1 | 5/2011 | Mancini et al. | F04B 11/00 |
| 2011/0108007 | A1* | 5/2011 | Mancini | F04B 1/0448 123/495 |
| 2011/0110807 | A1* | 5/2011 | Kobayashi | F04B 1/0452 417/540 |
| 2011/0110808 | A1* | 5/2011 | Inoue | F04B 11/0033 417/540 |
| 2011/0209687 | A1 | 9/2011 | Schroeder et al. | F02M 69/00 |
| 2011/0247488 | A1* | 10/2011 | Oikawa | F02M 59/44 92/144 |
| 2012/0006303 | A1* | 1/2012 | Usui | F02M 59/44 123/495 |
| 2012/0087817 | A1* | 4/2012 | Lucas | F04B 1/0404 417/540 |
| 2012/0195780 | A1* | 8/2012 | Matsumoto | F02M 59/02 417/559 |
| 2013/0001842 | A1 | 1/2013 | Kanaya | 267/140.13 |
| 2013/0052064 | A1* | 2/2013 | Oikawa | F04B 11/0016 417/540 |
| 2013/0209289 | A1* | 8/2013 | Lucas | F04B 11/00 417/395 |
| 2013/0230417 | A1* | 9/2013 | Kobayashi | F16L 55/0338 417/395 |
| 2013/0276929 | A1* | 10/2013 | Oikawa | F02M 59/102 138/26 |
| 2014/0193280 | A1 | 7/2014 | Saito | F04B 11/00 |
| 2014/0216418 | A1 | 8/2014 | Asayama | F02M 69/02 |
| 2015/0017040 | A1* | 1/2015 | Hishinuma | F02M 55/04 417/540 |
| 2015/0132165 | A1* | 5/2015 | Inoue | F02M 37/043 417/435 |
| 2015/0260133 | A1 | 9/2015 | Iwa | 92/47 |
| 2015/0260182 | A1* | 9/2015 | Kobayashi | F04B 43/02 417/205 |
| 2016/0169173 | A1* | 6/2016 | Yabuuchi | F02M 59/44 417/274 |
| 2016/0195084 | A1 | 7/2016 | Koehler | F02M 55/04 |
| 2016/0298581 | A1 | 10/2016 | Nah et al. | F02M 37/0041 |
| 2017/0276130 | A1 | 9/2017 | Usui et al. | F04B 53/14 |
| 2017/0335810 | A1 | 11/2017 | Tomitsuka et al. | F02M 37/0041 |
| 2017/0350354 | A1 | 12/2017 | Ostrosky et al. | F02M 37/00 |
| 2018/0171992 | A1 | 6/2018 | Saito | F02M 59/44 |
| 2018/0195478 | A1* | 7/2018 | Iwa | F16F 1/06 |
| 2018/0202401 | A1 | 7/2018 | Iwa et al. | F02M 55/04 |
| 2018/0209389 | A1* | 7/2018 | Iwa | F16L 55/054 |
| 2018/0223782 | A1 | 8/2018 | Yabuuchi et al. | F02M 55/04 |
| 2018/0274525 | A1* | 9/2018 | Schretling | F04B 11/00 |
| 2018/0306368 | A1* | 10/2018 | Yoshida | F16J 3/02 |
| 2018/0328322 | A1* | 11/2018 | Kashiwagi | F02M 37/0041 |
| 2019/0024646 | A1* | 1/2019 | Kurt | F04B 11/0033 |
| 2019/0048837 | A1* | 2/2019 | Mikhaylov | F04B 53/16 |
| 2019/0063388 | A1* | 2/2019 | Kurt | F02M 55/04 |
| 2019/0152455 | A1 | 5/2019 | Kai | B60T 17/00 |
| 2019/0285032 | A1* | 9/2019 | Loscrudato | F02M 55/005 |
| 2021/0164430 | A1* | 6/2021 | Sato | F02M 59/44 |
| 2021/0215127 | A1* | 7/2021 | Kashiwagi | F04B 35/01 |
| 2021/0239080 | A1* | 8/2021 | Sato | F02M 59/36 |
| 2021/0246860 | A1* | 8/2021 | Iwa | F02M 59/48 |
| 2021/0285589 | A1 | 9/2021 | Iwa | F04B 11/0033 |

FOREIGN PATENT DOCUMENTS

| | | | |
|---|---|---|---|
| CN | 104066968 | 9/2014 | F02M 59/34 |
| CN | 107002615 | 8/2017 | F02N 59/44 |
| CN | 107429642 | 12/2017 | F02M 33/00 |
| DE | 10 2014 219 997 | 4/2016 | F04B 11/00 |
| DE | 10 2015 219 537 | 4/2017 | F04B 11/00 |
| DE | 10 2015 219 768 | 4/2017 | F02M 55/04 |
| DE | 10 2015 223 159 | 6/2017 | F02M 37/00 |
| DE | 10 2016 203 217 | 8/2017 | F02M 55/04 |
| DE | 10 2016 205 428 | 10/2017 | F04B 11/00 |
| JP | 10-299609 | 11/1998 | F02M 55/00 |
| JP | 2005-42554 | 2/2005 | F02M 59/44 |
| JP | 2007-218264 | 8/2007 | F02M 55/00 |
| JP | 2008-14319 | 1/2008 | F02M 59/44 |
| JP | 2009-264239 | 11/2009 | F02M 59/44 |
| JP | 2012-197732 | 10/2012 | F02M 59/44 |
| JP | 2013-64364 | 4/2013 | F02M 59/44 |
| JP | 2014-190188 | 10/2014 | F02M 55/02 |
| JP | 2015-017585 | 1/2015 | |
| JP | 2015-017621 | 1/2015 | |
| JP | 2015-232283 | 12/2015 | F02M 55/00 |
| JP | 2016-113922 | 6/2016 | F02M 59/44 |
| JP | 2017-32069 | 2/2017 | F16F 9/04 |
| JP | 2018-71443 | 5/2018 | F02M 59/44 |
| KR | 10-2012-0090452 | 8/2012 | F02M 59/14 |
| WO | WO 2016/190096 | 1/2016 | F02M 59/44 |
| WO | WO 2017/022604 | 2/2017 | F16F 9/04 |
| WO | WO-2017022603 A1 * | 2/2017 | B23K 26/28 |
| WO | WO-2017167499 A1 * | 10/2017 | B23K 26/28 |
| WO | WO2017195415 | 11/2017 | |
| WO | WO2018056109 | 3/2018 | F02M 55/04 |

OTHER PUBLICATIONS

International Preliminary Report on Patentability issued in PCT/JP2019/019619, dated Nov. 24, 2020, with English translation, 10 pages.

International Search Report and Written Opinion issued in PCT/JP2019/019619, dated Aug. 13, 2019, with English translation, 18 pages.

International Preliminary Report on Patentability issued in PCT/JP2019/019618, dated Nov. 24. 2020, with English translation, 10pages.

International Search Report and Written Opinion issued in PCT/JP2019/019618, dated Jun. 25, 2019, with English translation, 19 pages.

International Preliminary Report on Patentability issued in PCT/JP2019/019616, dated Nov. 24, 2020, with English translation, 6 pages.

International Search Report and Written Opinion issued in PCT/

(56) References Cited

OTHER PUBLICATIONS

JP2019/019616, dated Jul. 9, 2019, with English translation, 11 pages.
International Preliminary Report on Patentability issued in PCT/JP2019/020195, dated Dec. 1, 2020, with English translation, 7 pages.
International Search Report and Written Opinion issued in PCT/JP2019/020195, dated Jul. 30, 2019, with English translation, 12 pages.
International Preliminary Report on Patentability issued in PCT/JP2019/019615, dated Nov. 24, 2020, with English translation, 7 pages.
International Search Report and Written Opinion issued in PCT/JP2019/019615, dated Aug. 13, 2019, with English translation, 15 pages.
Official Action dated Oct. 1, 2021, issued in related U.S. Appl. No. 17/048,568, 8 pages.
Official Action dated Sep. 21, 2021, issued in related U.S. Appl. No. 17/048,980, 19 pages.
Notice of Allowance dated Sep. 21, 2021, issued in related U.S. Appl. No. 17/762,111, 9 pages.
Notice of Allowance dated Oct. 19, 2021, issued in related U.S. Appl. No. 17/048,992, 7 pages.
Notice of Allowance dated Oct. 27, 2021, issued in related U.S. Appl. No. 17/050,422, 14 pages.
Official Action dated Jun. 24, 2021, issued in related U.S. Appl. No. 17/762,111, 21 pages.
Official Action dated Apr. 1, 2021, issued in related U.S. Appl. No. 17/762,111, 20 pages.
"Development of Optimal diaphragm-based pulsation damper structure for high-pressure GDI pump systems through design of experiments", NPL Scientific Journal Publication; retrieved Sep. 2, 2021, https://www.sciencedirect.com/science/article/pii/S0957415813000238 (Year 2013).
International Preliminary Report on Patentability issued in PCT/JP2018/042765, dated May 26, 2020, 5 pages.
International Search Report and Written Opinion issued in PCT/JP2018/042765, dated Feb. 12, 2019, with English translation, 15 pages.
Supplemental European Search Report issued in corresponding European Patent Application No. 18882045.0, dated Jun. 15, 2021, 7 pages.
Chinese Official Action issued in related Chinese Patent Application Serial No. 201880073747.6, dated Jun. 1, 2021 (17 pages).
Chinese Official Action issued in related Chinese Patent Application Serial No. 201980025963.8, dated Sep. 28, 2021 (13 pages).
Chinese Official Action issued in related Chinese Patent Application Serial No. 201980026782.7, dated Oct. 9, 2021 (11 pages).
Chinese Official Action issued in related Chinese Patent Application Serial No. 201980026783.7, dated Oct. 9, 2021 (13 pages).
Chinese Official Action issued in related Chinese Patent Application Serial No. 201980029574.2, dated Oct. 11, 2021 (12 pages).
Chinese Official Action issued in related Chinese Patent Application Serial No. 201980029484.3, dated Oct. 11, 2021 (13 pages).
U.S. Appl. No. 17/048,980, filed Oct. 19, 2020, Sato et al.
U.S. Appl. No. 17/048,992, filed Oct. 19, 2020, Iwa et al.
U.S. Appl. No. 17/050,422, filed Oct. 23, 2020, Iwa et al.
U.S. Appl. No. 17/052,168, filed Oct. 30, 2020, Iwa et al.
Official Action dated Jun. 18, 2021, issued in related U.S. Appl. No. 17/050,422, 15 pages.

* cited by examiner

DAMPER DEVICE

TECHNICAL FIELD

The present invention relates to a damper device configured to absorb pulsation generated by delivery of liquid by, e.g., a pump.

BACKGROUND ART

For example, when, e.g., an engine is driven, a high-pressure fuel pump is used to pressure-feed fuel supplied from a fuel tank to an injector side. The high-pressure fuel pump performs pressurization and discharge of fuel by reciprocation of a plunger to be driven by rotation of a cam shaft of an internal combustion engine.

In a fuel pressurization/discharge mechanism in the high-pressure fuel pump, the suction stroke of opening a suction valve upon lowering of the plunger to suck fuel into a pressurization chamber from a fuel chamber formed on a fuel inlet side is first performed. Next, the amount adjustment stroke of returning part of fuel of the pressurization chamber to the fuel chamber upon lifting of the plunger is performed, and after the suction valve has been closed, the pressurization stroke of pressurizing fuel upon further lifting of the plunger is performed. As described above, the high-pressure fuel pump repeats the cycle of the suction stroke, the amount adjustment stroke, and the pressurization stroke, thereby pressurizing fuel and discharging the fuel to the injector side. Due to drive of the high-pressure fuel pump as described above, pulsation is generated in the fuel chamber.

In this high-pressure fuel pump, a damper device configured to reduce the pulsation generated in the fuel chamber is built in the fuel chamber. For example, a damper device disclosed in Patent Citation 1 includes, between two diaphragms, a discoid damper body sealed with gas. The damper body includes a deformation acting portion on the center side, and the deformation acting portion is elastically deformed in response to a fuel pressure associated with the pulsation. Thus, the volume of the fuel chamber is changed, and the pulsation is reduced.

A fuel chamber portion in the high-pressure fuel pump is formed as a space sealed from the outside by a device main body and a cup-shaped cover member surrounding part of the device main body. When the damper device is installed in the fuel chamber, the cover member is attached to the device main body after the damper device has been mounted on the device main body.

In the damper device of Patent Citation 1, upper and lower sandwiching portions are attached to an outer peripheral edge portion of a diaphragm damper, and after these upper and lower sandwiching portions have been fitted in a recessed portion formed at a pump housing, the upper and lower sandwiching portions are sandwiched by a damper cover and the pump housing. Thus, the diaphragm damper and the upper and lower sandwiching portions can be installed in an unmovable state in the fuel chamber.

CITATION LIST

Patent Literature

Patent Citation 1: JP 2009-264239 A (Page 14, FIG. 8)

SUMMARY OF INVENTION

However, in the damper device of Patent Citation 1, it is, as described above, necessary to attach the upper and lower sandwiching portions to the outer peripheral edge portion of the diaphragm damper and further fit these upper and lower sandwiching portions in the recessed portion formed at the pump housing. Thus, there is a problem that the process of attaching the damper device is complicated.

The present disclosure has been made in view of such a problem, and is intended to provide a damper device installable by a simple process.

A damper device according to a disclosure of an aspect of the present invention is a damper device used with the damper device being arranged in a housing space formed between a device main body and a cover member, which includes a pair of damper bodies each having a plate and a diaphragm and having an enclosed space sealed with gas, biasing means provided between the pair of damper bodies arranged such that the plates face each other and configured to bias the damper bodies from one side of the device main body and the cover member to other side of the device body and the cover member, stay members each extending from an outer peripheral edge portion of each of the damper bodies and brought into contact with the other side, and a frame member arranged on one side of the device main body and the cover member and having a stopper portion configured to restrict movement of the damper bodies in the direction of the other side.

According to this configuration, when the cover member is fixed to the device main body, the damper body is integrally held in a state in which biasing force from the biasing means acts between the biasing means and the stay member, and therefore, the damper device can be installed in the housing space by a simple process.

The biasing means may be a wave spring arranged between outer peripheral edge portions of the damper bodies.

According to this configuration, the pair of damper bodies can be uniformly biased in a separation direction.

Restriction means configured to restrict movement of the wave spring in a radial direction may be formed at each of the plates.

According to this configuration, the center axes of the pair of damper bodies and the wave spring can be coaxially arranged, and the pair of damper bodies can be uniformly pressed in the separation direction.

A cross-shaped groove may be formed at a center portion of each of the plates.

According to this configuration, stiffness of the plates can be improved, and stability upon installation of the damper device can be ensured.

Each of the stay members includes a tubular portion formed in an annular shape and the tubular portion may be provided with multiple holes formed apart from each other in a circumferential direction of the tubular portion.

According to this configuration, the tubular portion can stably contact a device main body side or a cover member side. Moreover, fluid can pass around the damper body through the holes, and pulsation reduction performance can be ensured.

A damper stopper contactable with an outer peripheral edge of the damper device and an end portion of the damper device in an axial direction may be attached to the inside of a cover member main body forming the cover member.

According to this configuration, the damper stopper is arranged between the cover member main body and the damper device. Thus, movement of the damper device can be restricted, and vibration of the damper device and the cover member main body can be prevented.

DESCRIPTION OF EMBODIMENTS

Hereinafter, a mode for carrying out a damper device according to the present invention will be described based on an embodiment.

EMBODIMENT

A damper device according to an embodiment will be described with reference to FIGS. 1 to 6.

Figure 1:
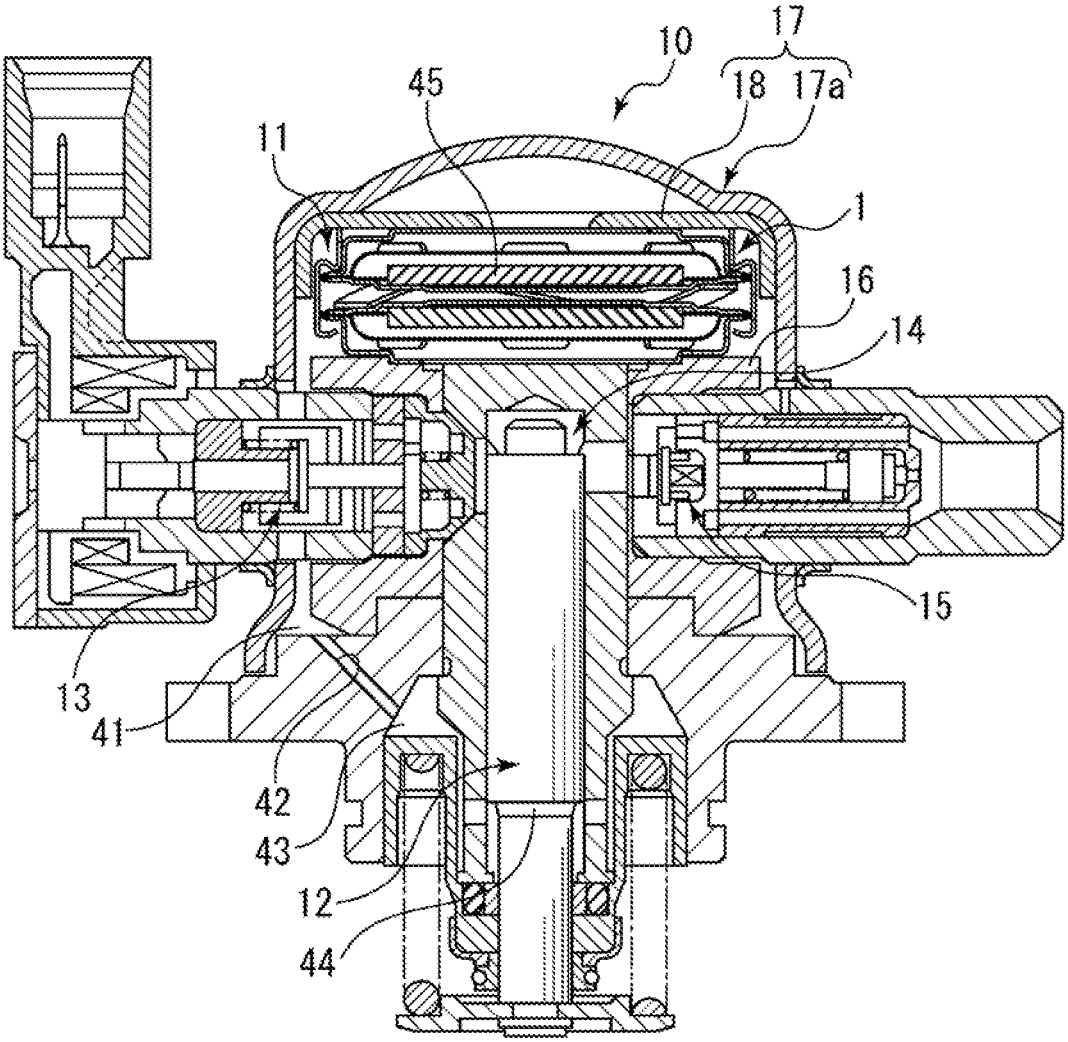
FIG. 1 is a sectional view illustrating a high-pressure fuel pump in which a damper device according to an embodiment of the present invention is built.

As illustrated in FIG. 1, the damper device 1 of the present embodiment is built in a high-pressure fuel pump 10 configured to pressure-feed fuel to an injector side, the fuel being supplied to a rail as a high-pressure pipe by way of a suction valve, a pressurization chamber, and a discharge valve after having passed a damper chamber from a fuel tank through a not-shown fuel inlet. The high-pressure fuel pump 10 performs pressurization and discharge of fuel by reciprocation of a plunger 12 to be driven by rotation of a not-shown camshaft of an internal combustion engine.

In a fuel pressurization/discharge mechanism in the high-pressure fuel pump 10, the suction stroke of opening a suction valve 13 upon lowering of a plunger 12 to suck fuel into a pressurization chamber 14 from a fuel chamber 11 formed on a fuel inlet side is first performed. Note that as a flow different from that described above, there is also a fuel flow from the fuel chamber 11 to a flange path 42, a sub-pump chamber 43, and a plunger stopper path 44 by way of a gallery 41. Next, the amount adjustment stroke of returning part of fuel of the pressurization chamber 14 to the fuel chamber 11 upon lifting of the plunger 12 is performed, and after the suction valve 13 has been closed, the pressurization stroke of pressurizing fuel upon further lifting of the plunger 12 is performed.

As described above, the high-pressure fuel pump 10 repeats the cycle of the suction stroke, the amount adjustment stroke, and the pressurization stroke, thereby pressurizing fuel and discharging the fuel to the injector side after a discharge valve 15 has been opened. At this point, pulsation repeating a high pressure and a low pressure is generated in the fuel chamber 11. The damper device 1 is used for reducing such pulsation generated in the fuel chamber 11 of the high-pressure fuel pump 10.

Figure 2:
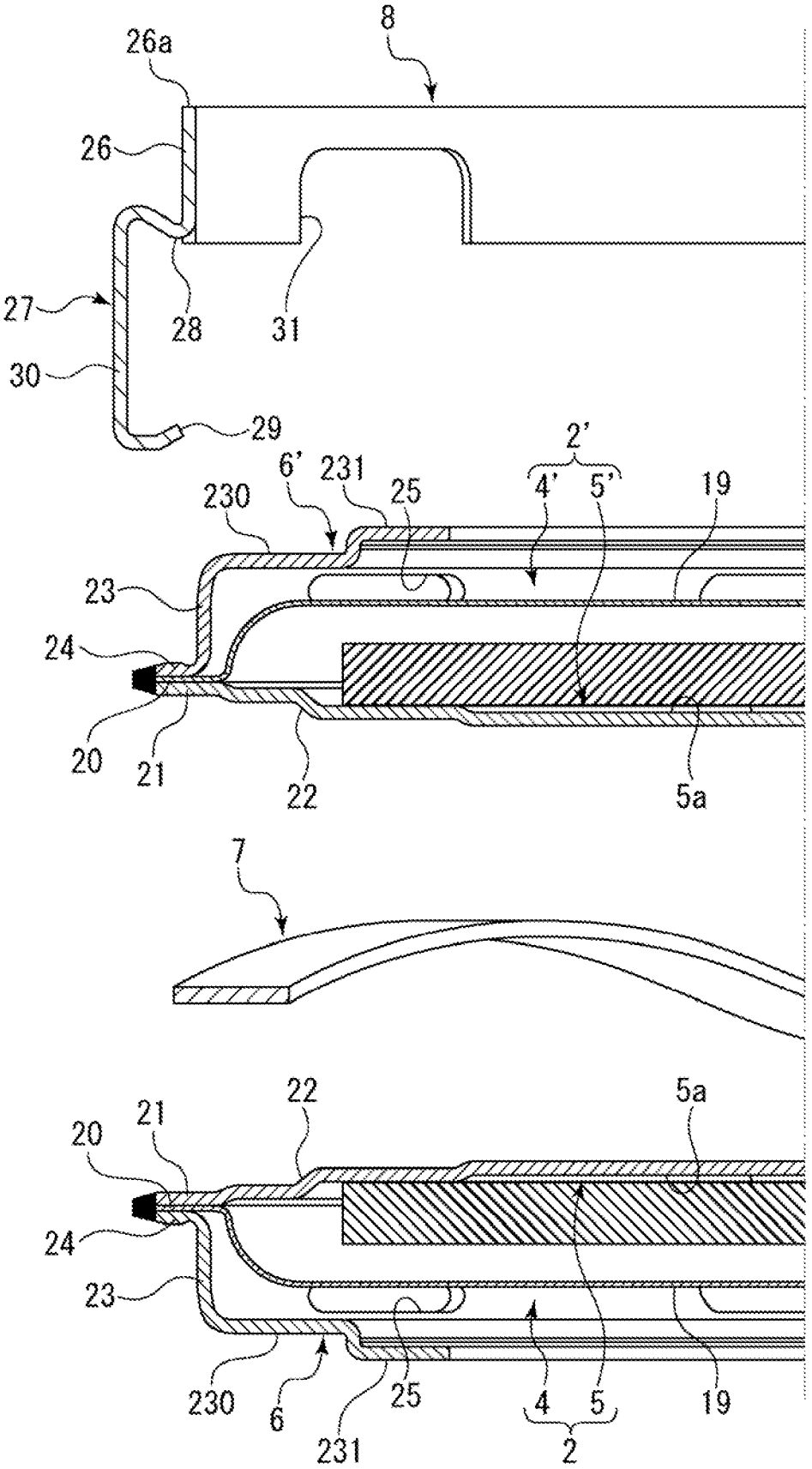
FIG. 2 is an exploded sectional view illustrating members forming the damper device.

As illustrated in FIG. 2, the damper device 1 includes a damper body 2 having a diaphragm 4 and a plate 5, a stay member 6 fixed to the damper body 2, a damper body 2' as a second damper body and a stay member 6' as a second stay member arranged symmetrical to the damper body 2 and the stay member 6 in an axial direction, a wave spring 7 as biasing means arranged between the damper bodies 2, 2', and a frame member 8. Moreover, a rubber material 45 may be mounted in an internal space of the damper body 2, or may be installed with the rubber material 45 being bonded to the plate 5.

The diaphragm 4 is, as a whole, formed into a dish shape having a uniform thickness by pressing of a metal plate. A deformation acting portion 19 bulging in the axial direction is formed on the center side in a radial direction, and on an outer diameter side of the deformation acting portion 19, a flat plate annular outer peripheral edge portion 20 is formed to extend from the deformation acting portion 19 in an outer diameter direction. The diaphragm 4 has such a structure that the deformation acting portion 19 is easily deformable in the axial direction by a fluid pressure in the fuel chamber 11.

The plate 5 is formed into a flat plate shape by pressing of a metal plate having a greater thickness than that of the metal plate forming the diaphragm 4. The plate 5 is in a stepped planar shape on an inner diameter side, and an outer peripheral edge portion 21 overlapping with the outer peripheral edge portion 20 of the diaphragm 4 is formed on the outer diameter side. The plate 5 is in the flat plate shape having a thickness, and has such a structure that the plate 5 is not deformed by the fluid pressure in the fuel chamber 11. Moreover, an annular raised portion 22 as restriction means formed with a slightly-smaller diameter than the inner diameter of the wave spring 7 is formed inside the outer peripheral edge portion 21. When the damper body 2 and the wave spring 7 are assembled with each other, movement of the wave spring 7 in the radial direction is restricted, and the wave spring 7 and the diaphragms 4, 4' are aligned with each other.

Figure 3:
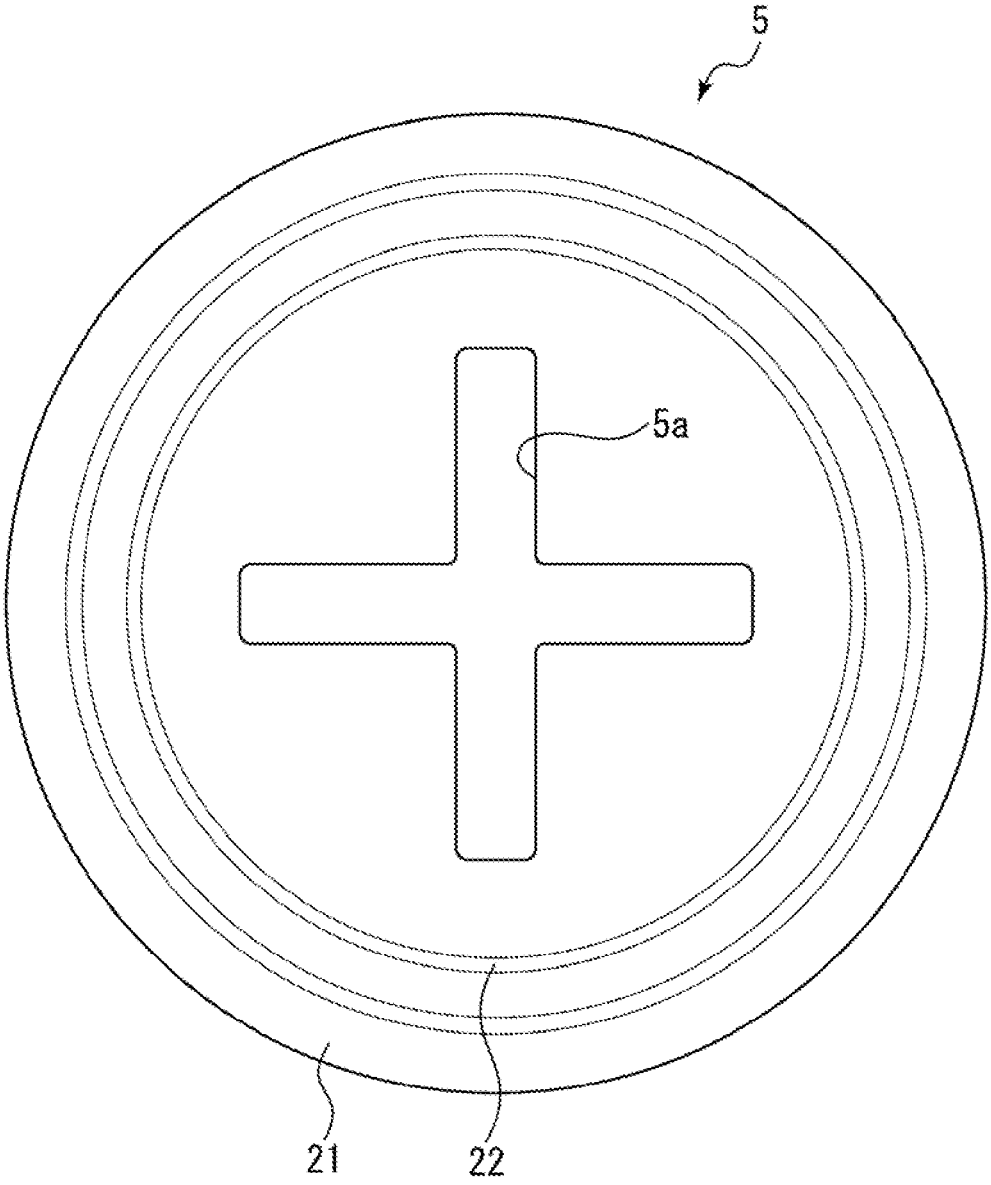
FIG. 3 is a plan view illustrating a plate in the embodiment.

Moreover, as illustrated in FIG. 3, a cross-shaped groove **5*a* is formed at a center portion of the plate 5. Thus, stiffness of the plate 5 can be improved, and stability in installation of the damper device 1 as described later can be ensured. Specifically, distortion and deformation of the damper device 1 can be prevented, and detachment of the wave spring 7** can be prevented.

Figure 4:
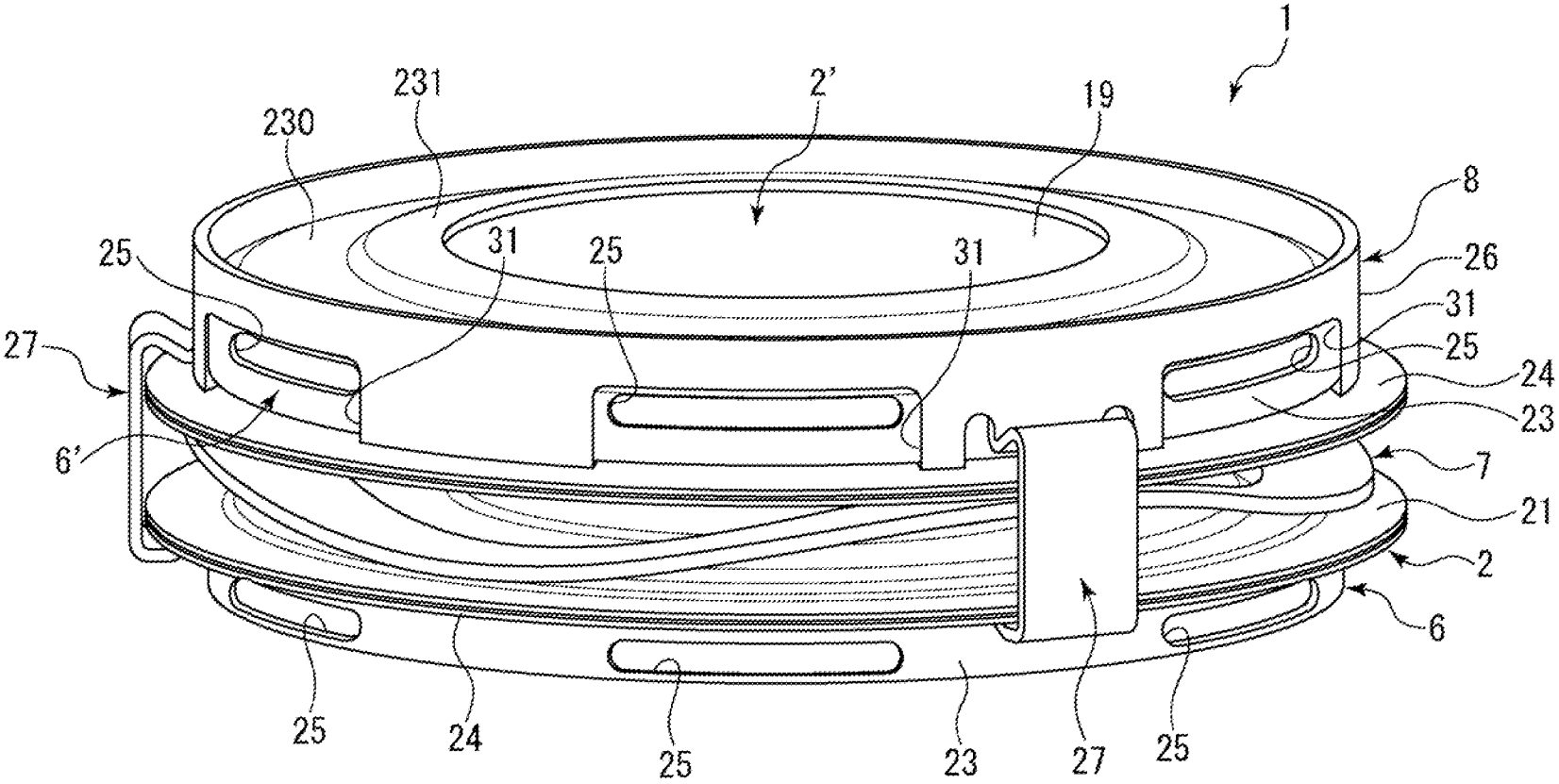
FIG. 4 is a perspective view illustrating the damper device.

As illustrated in FIGS. 2 and 4, the stay member 6 includes an annular tubular portion 23 surrounding the deformation acting portion 19 of the diaphragm 4 in a circumferential direction and formed with a through-hole penetrating the tubular portion 23 in the radial direction. On the outer diameter side of the tubular portion 23, an outer peripheral edge portion 24 overlapping with the outer peripheral edge portion 21 of the plate 5 is formed. On the inner diameter side of the tubular portion 23, an extension portion 230 extending in an inner diameter direction and an end surface 231 protruding from the extension portion 230 to the opposite side of the tubular portion 23 are formed. Moreover, multiple through-holes 25 are formed apart from each other in the circumferential direction at the tubular portion 23.

As illustrated in FIG. 2, the outer peripheral edge portion 20 of the diaphragm 4, the outer peripheral edge portion 21 of the plate 5, and the outer peripheral edge portion 24 of the stay member 6 are welded and fixed to each other in the circumferential direction. The outer peripheral edge portion 20 of the diaphragm 4 and the outer peripheral edge portion 21 of the plate 5 are welded and fixed to each other, and therefore, the inside of the damper body 2 is sealed. Moreover, the diaphragm 4, the plate 5, and the stay member 6 are integrally fixed to each other. Thus, not only assembly of the damper device 1 can be facilitated, but also damage of the diaphragm 4 due to collision with the tubular portion 23 of the stay member 6 can be prevented.

As illustrated in FIGS. 2 and 4, the wave spring 7 is formed in such a manner that an annular plate-shaped steel wire is deformed into a wave shape, and can provide biasing force in the axial direction.

As illustrated in FIGS. 2 and 4, the frame member 8 includes an annular tubular portion 26 surrounding the annular tubular portion 23 of the other stay member 6' in the circumferential direction and formed with a through-hole penetrating the tubular portion 26 in the axial direction, and three stopper portions 27 (only two stopper portions 27 are illustrated in FIG. 4) apart from each other in the circumferential direction of the tubular portion 26 are provided to extend from the tubular portion 26. The stopper portion 27 has a first lock portion 28 to be locked at the outer peripheral edge portion 24 of the other stay member 6' from the outside in the axial direction and a second lock portion 29 to be locked at the outer peripheral edge portion 24 of one stay member 6 from the outside in the axial direction, and the first lock portion 28 and the second lock portion 29 are continuously formed through a linear extension portion 30.

Moreover, at the tubular portion 26 of the frame member 8, multiple cutout-shaped openings 31 are formed apart from each other in the circumferential direction with phases corresponding to the through-holes 25 formed at the tubular portion 23 of the other stay member 6'.

Figure 5:
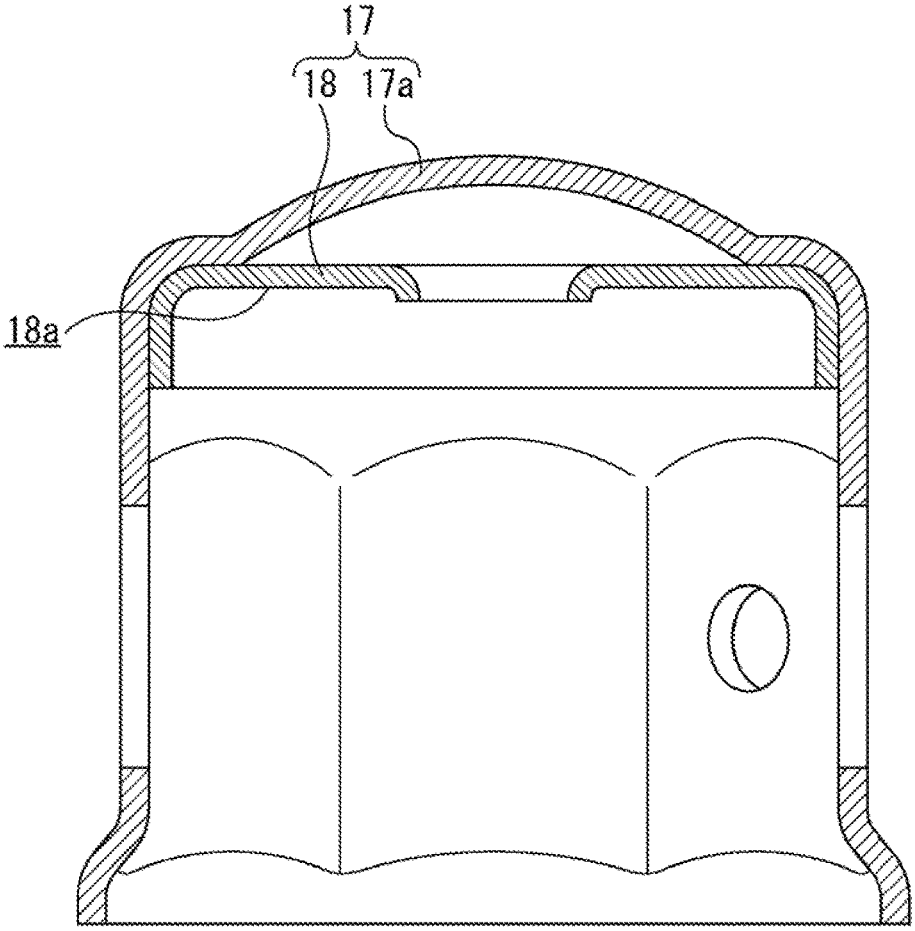
FIG. 5 is an exploded sectional view illustrating a device main body and a cover member forming a housing space and the damper device before installation.
Figure 5:
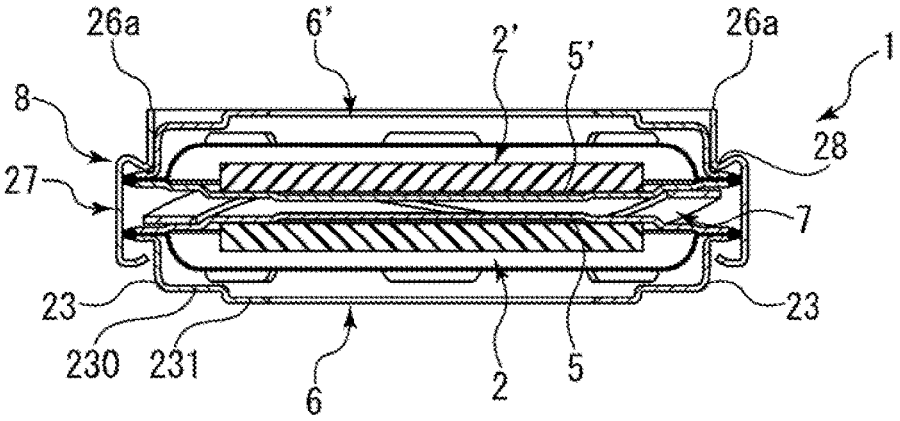
Figure 5:
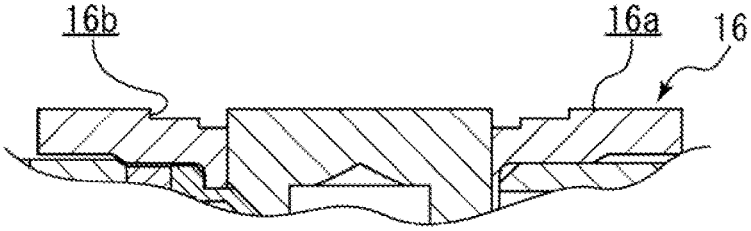

As illustrated in FIG. 5, the damper device 1 is formed as follows: the other damper body 2' and the stay member 6' are assembled with the tubular portion 26 of the frame member 8, the wave spring 7 is arranged between one damper body 2 and the other damper body 2', and the second lock portions 29 of the stopper portions 27 of the frame member 8 are locked at the stay member 6; and in this manner, these components are integrally formed into a unit.

As illustrated in FIG. 5, the tubular portion 26 of the frame member 8 is formed with a greater height dimension than that of the tubular portion 23 of the stay member 6', and in a state in which the frame member 8 and the stay member 6' are assembled with each other, an end portion 26*a* of the tubular portion 26 of the frame member 8 protrudes to the outside with respect to the stay member 6'. Thus, the other stay member 6' is not movable relative to the frame member 8.

Moreover, one stay member 6 can be guided by the second lock portions 29 of the stopper portions 27 of the frame member 8, and therefore, can be relatively moved. Thus, movement of the damper body 2 and the damper body 2', which are each fixed to the stay member 6 and the stay member 6', relative to the frame member 8 can be smoothly performed.

Subsequently, the step of installing the damper device 1 will be described with reference to FIGS. 5 and 6. A fuel chamber 11 portion in the high-pressure fuel pump 10 includes a device main body 16 and a cover member 17 surrounding part of the device main body 16. A damper stopper 18 contactable with an outer peripheral edge of the damper device 1 and an end portion of the damper device 1 in the axial direction is attached inside a cover member main body 17*a* of the cover member 17.

One stay member 6 of the damper device 1 as the unit engages with an installation portion 16*b* of the device main body 16. Subsequently, after having contacted the device main body 16 from above, the cover member 17 is fixed liquid-tightly. Upon such contact motion, an inner surface 18*a* of the damper stopper 18 forming the cover member 17 moved closer to the device main body 16 contacts the end portion 26*a* of the tubular portion 26 of the frame member 8, and thereafter, the frame member 8 is pressed in association with movement of the cover member 17. Accordingly, the first lock portions 28 of the stopper portions 27 of the frame member 8 press the outer peripheral edge portion 24 of the other stay member 6' in the direction of one stay member 6. Due to reactive force from one stay member 6 contacting the device main body 16, the stay members 6, 6' move closer to each other, and the damper body 2 and the damper body 2' move closer to each other.

Figure 6:
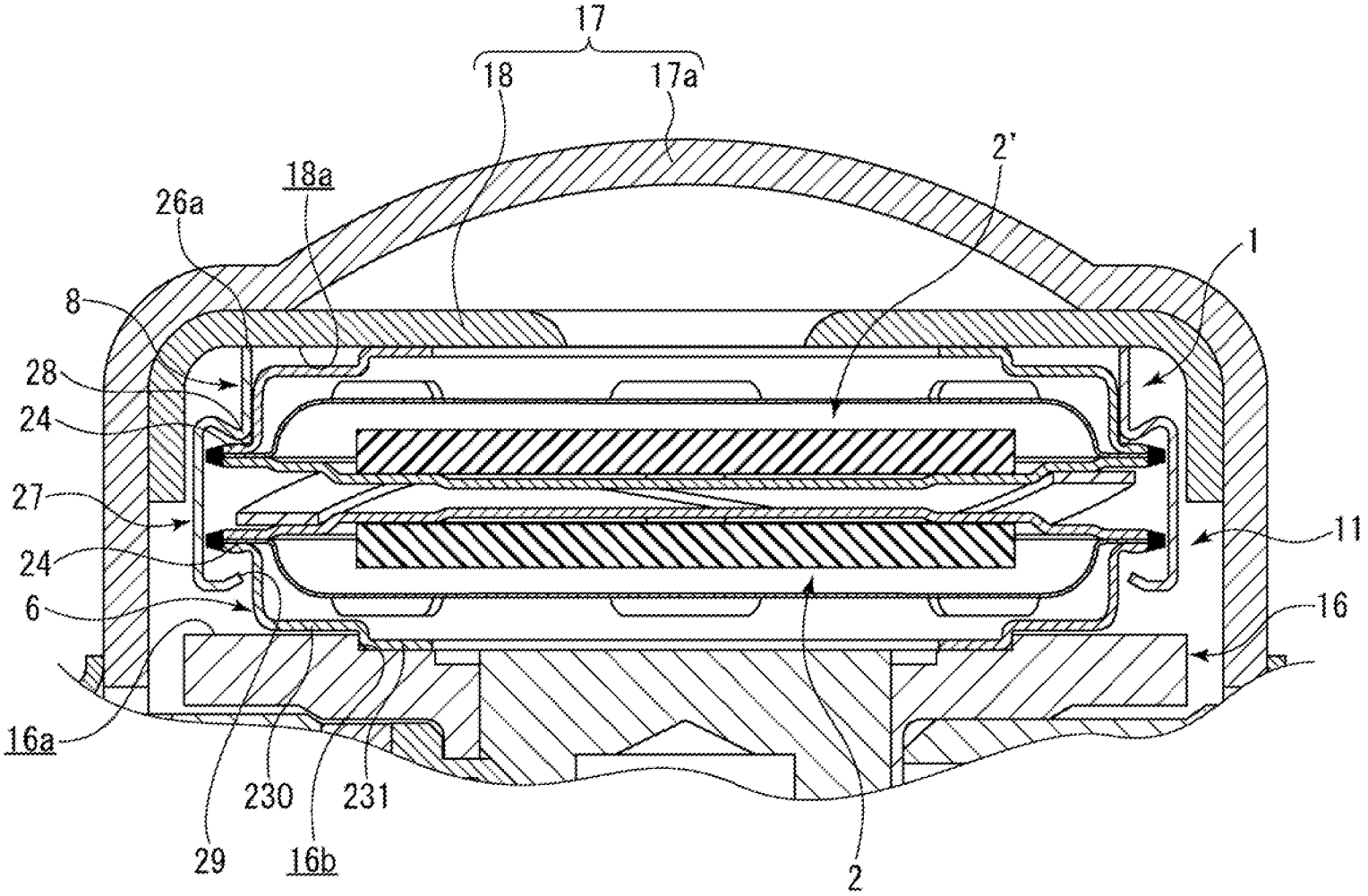
FIG. 6 is a sectional view illustrating a state in which installation of the damper device in the housing space has been completed.

As illustrated in FIG. 6, the damper body 2 and the damper body 2' move closer to each other, and therefore, the wave spring 7 is compressed and the outer peripheral edge portion 24 of the stay member 6 and the second lock portions 29 of the stopper portions 27 are apart from each other. In a state in which fixing of the cover member 17 and the device main body 16 has been completed, the damper body 2 and the damper body 2' are pressed in a separation direction of the axial direction by the biasing force of the wave spring 7 in the axial direction, the end portion 26*a* of the tubular portion 26 of the frame member 8 forming an annular surface is pressed against the inner surface 18*a* of the damper stopper 18 of the cover member 17, the end surface 231 of one stay member 6 similarly forming an annular surface is pressed against the installation portion 16*b* of the device main body 16, and the damper device 1 is stably held on the fuel chamber 11 portion.

Moreover, the damper stopper 18 is arranged between the cover member main body 17*a* and the damper device 1, and therefore, movement of the damper device 1 can be restricted and vibration of the damper device 1 and the cover member main body 17*a* can be prevented.

Subsequently, pulsation absorption of the damper device 1 upon reception of a fuel pressure associated with the pulsation repeating the high pressure and the low pressure will be described. Enclosed spaces in the damper bodies 2, 2' are sealed with gas having a predetermined pressure, such as argon or helium. Note that the damper bodies 2, 2' can obtain desired pulsation absorption performance by volume change amount adjustment by the pressure of the gas sealed in the damper bodies 2, 2'. Moreover, the internal pressures of the damper bodies 2, 2' may be changed.

When the fuel pressure associated with the pulsation becomes the high pressure from the low pressure and a fuel pressure from a fuel chamber 11 side is on the diaphragms 4, 4', the deformation acting portion 19 is pushed inwardly, and the gas in the damper bodies 2, 2' is compressed. The deformation acting portion 19 is elastically deformed in response to the fuel pressure associated with the pulsation, and therefore, the volume of the fuel chamber 11 can be changed and the pulsation can be reduced.

Moreover, movement of the wave spring 7 in the radial direction is restricted by the raised portion 22 (i.e., the restriction means) formed at the plate 5, and therefore, the center axes of the damper bodies 2, 2' and the wave spring 7 can be coincident with each other and the damper bodies 2, 2' can be uniformly pressed in the separation direction.

Further, the stay member 6' and the frame member 8 are assembled with each other such that the through-holes 25 formed at the tubular portion 23 of the other stay member 6' and the openings 31 formed at the tubular portion 26 of the frame member 8 overlap with each other, and therefore, the outside of the stay member 6', i.e., an internal space of the fuel chamber 11, and the inside of the stay member 6, i.e., a space around the damper body 2', are communicated with each other through the through-holes 25 and the openings 31.

In addition, a space around one damper body 2 is communicated with the outside of the stay member 6 through the through-holes 25 of one stay member 6. Further, the width dimension of the stopper portion 27 at the frame member 8 is smaller than a separation distance between the through-holes 25 of the stay member 6 in the circumferential direction. The stopper portion 27 is arranged between adjacent ones of the through-holes 25 of the stay member 6, and therefore, a flow path connecting the space around the damper body 2 and the outside of the stay member 6' is not blocked.

As described above, the members contacting the cover member 17 and the device main body 16 are in the annular shape. Thus, the damper device 1 can be stably held in the fuel chamber 11. Meanwhile, the fuel pressure associated with the pulsation repeating the high pressure and the low pressure in the fuel chamber 11 can be directly on the damper bodies 2, 2', and sufficient pulsation reduction performance can be ensured.

As described above, only by movement of the device main body 16 and the cover member 17 closer to each other by the biasing force of the wave spring 7, the damper body 2 can be held between the wave spring 7 and the stay member 6 each positioned on a device main body 16 side and a cover member 17 side. Thus, the damper device 1 can be installed in a housing space by a simple process.

Moreover, the damper body 2' different from the damper body 2 is arranged between the frame member 8 and the wave spring 7. Thus, the damper bodies 2, 2' are arranged on upper and lower sides by a simple configuration, and the pulsation reduction performance of the damper device 1 is high.

Further, in the case of the configuration in which the damper device is sandwiched by the device main body 16 and the cover member 17 as in the present embodiment, the thickness dimension of the damper device contacting the device main body 16 and the cover member 17 and an upper-lower separation distance between the device main body 16 and the cover member 17 has typically needed to be coincident with each other for installing the damper device in, e.g., the fuel chamber 11 without rattling, and processing accuracy has been demanded. However, in the damper device 1 of the present embodiment, it is configured such that the wave spring 7 is arranged between the damper bodies 2, 2'. Thus, an upper-lower dimension is adjusted corresponding to the upper-lower separation distance between the device main body 16 and the cover member 17 of the damper device 1, and therefore, upper-lower dimension adjustment as described above is facilitated.

In addition, the multiple stopper portions 27 are provided apart from each other in the circumferential direction of the tubular portion 26, and are formed to protrude to the outer diameter side with respect to the tubular portion 26. Thus, if the damper device 1 has moved in the radial direction due to, e.g., vibration, the stopper portions 27 contact the cover member 17 before the damper bodies 2, 2' and the stay members 6, 6', and therefore, damage of the damper bodies 2, 2' can be effectively prevented.

Moreover, in the damper device 1, the end portion 26*a* of the tubular portion 26 of the frame member 8 contacts the inner surface 18*a* of the damper stopper 18 of the cover member 17, and the end surface 231 of one stay member 6 is arranged to engage with the installation portion 16*b* of the device main body 16. With this configuration, a stopper portion 27 side of the frame member 8 on which fluid is less blockable as compared to an annular tubular portion 26 side can be on an inlet side of fluid flowing into the fuel chamber 11.

Further, the first lock portion 28 of the stopper portion 27 of the frame member 8 is formed to bend from the tubular portion 26. Thus, in the process of installing the damper device 1, strength against stress when the outer peripheral edge portion 24 of the other stay member 6' is pressed in association with movement of the cover member 17 is enhanced, and damage of the stopper portion 27 can be effectively prevented.

The embodiment of the present invention has been described above with reference to the drawings, but specific configurations are not limited to those of the embodiment. Even changes and additions made without departing from the scope of the present invention are included in the present invention.

For example, in the above-described embodiment, the example where the damper device 1 is installed in the fuel chamber 11 such that the end portion 26*a* of the tubular portion 26 of the frame member 8 contacts the inner surface 18*a* of the damper stopper 18 of the cover member 17 and the end surface 231 of one stay member 6 is arranged to engage with the installation portion 16*b* of the device main body 16 has been described. Conversely, an installation portion may be provided at the inner surface 18*a* of the damper stopper 18 of the cover member 17, the other stay member 6' may be engaged with the installation portion of the cover member 17, and the frame member 8 may be arranged to contact the device main body 16.

Moreover, in the above-described embodiment, the configuration in which the tubular portion 23 of the other stay member 6' is arranged inside the tubular portion 26 of the frame member 8 has been described, but the present invention is not limited to such a configuration. For example, the stay member 6' on a frame member 8 side may be omitted, and one damper body 2 may be directly fixed to the frame member 8.

Further, in the above-described embodiment, the example where the outer peripheral edge portion 20 of the diaphragm 4, the outer peripheral edge portion 21 of the plate 5, and the outer peripheral edge portion 24 of the stay member 6 are integrally welded and fixed to each other in the circumferential direction has been described, but the present invention is not limited to such an example. For example, it may be configured such that the outer peripheral edge portion 20 of the diaphragm 4 and the outer peripheral edge portion 21 of the plate 5 are welded and fixed to each other and the outer peripheral edge portion 21 of the plate 5 and the outer peripheral edge portion 24 of the stay member 6 are not fixed to each other.

In addition, one damper body 2 and the other damper body 2' do not necessarily have the same shape. Similarly, one stay member 6 and the other stay member 6' do not necessarily have the same shape.

Moreover, in the above-described embodiment, the form in which the damper device 1 is provided in the fuel chamber 11 of the high-pressure fuel pump 10 to reduce the pulsation in the fuel chamber 11 has been described, but the present invention is not limited to such a form. For example, the damper device 1 may be provided at, e.g., a fuel pipe connected to the high-pressure fuel pump 10 to reduce the pulsation.

Further, the restriction means configured to restrict movement of the wave spring 7 in the radial direction and align the wave spring and the diaphragm with each other is not limited to the annular raised portion, and may be multiple scattered raised portions or an annular recessed portion.

REFERENCE SIGNS LIST

1 Damper device
2 Damper body
2' Damper body
4 Diaphragm
5 Plate
5*a* Cross-shaped groove
6 Stay member
6' Stay member
7 Wave spring
8 Frame member
10 High-pressure fuel pump
11 Fuel chamber
12 Plunger
13 Suction valve
14 Pressurization chamber
15 Discharge valve
16 Device main body
17 Cover member
17*a* Cover member main body
18 Damper stopper
19 Deformation acting portion
22 Raised portion (restriction means)
25 Through-hole
27 Stopper portion
28 First lock portion
29 Second lock portion
31 Opening

The invention claimed is:

1. A damper device used with the damper device being arranged in a housing space formed between a device main body and a cover member, comprising:

a first damper body having a plate and a diaphragm and having an enclosed space sealed with gas;

a second damper body having a plate and a diaphragm and having an enclosed space sealed with gas, the first damper body and the second damper body being arranged on sides of the device main body and the cover member, respectively, such that the plates face each other, a biasing device provided between the first damper body and second damper body and configured to bias the first damper body and the second damper body toward the device main body and the cover member, respectively;

a first stay member fixed to an outer peripheral edge portion of the first damper body and extending from the outer peripheral edge portion of the first damper body to come into contact with the device main body;

a second stay member fixed to an outer peripheral edge portion of the second damper body and extending from the outer peripheral edge portion of the second damper body to come into contact with the cover member;

and a frame member formed separately from the first stay member and the second stay member and having an end portion brought into contact with the device main body or the cover member and a stopper portion configured to restrict movement of the outer peripheral edge portion of the first damper body toward the device main body and movement of the outer peripheral edge portion of the second damper body toward the cover member.

2. The damper device according to claim 1, wherein the biasing device is a wave spring arranged between the outer peripheral edge portions of the first damper body and the second damper body.

3. The damper device according to claim 2, further comprising a raised portion provided at the plate of at least one of the first damper body and the second damper body and configured to restrict movement of the wave spring in a radial direction.

4. The damper device according to claim 3, wherein a cross-shaped groove is formed at a center portion of each of the plates of the first damper body and the second damper body.

5. The damper device according to claim 3, wherein each of the first stay member and the second stay member includes a tubular portion formed in an annular shape, the tubular portion being provided with multiple holes formed apart from each other in a circumferential direction of the tubular portion.

6. The damper device according to claim 3, wherein a damper stopper contactable with an outer peripheral edge of the damper device and an end portion of the damper device in an axial direction is attached to an inside of a cover member main body forming the cover member.

7. The damper device according to claim 2, wherein a cross-shaped groove is formed at a center portion of each of the plates of the first damper body and the second damper body.

8. The damper device according to claim 2, wherein each of the first stay member and the second stay member includes a tubular portion formed in an annular shape, the tubular portion being provided with multiple holes formed apart from each other in a circumferential direction of the tubular portion.

9. The damper device according to claim 2, wherein a damper stopper contactable with an outer peripheral edge of the damper device and an end portion of the damper device in an axial direction is attached to an inside of a cover member main body forming the cover member.

10. The damper device according to claim 1, wherein a cross-shaped groove is formed at a center portion of each of the plates of the first damper body and the second damper body.

11. The damper device according to claim 10, wherein each of the first stay member and the second stay member includes a tubular portion formed in an annular shape, the tubular portion being provided with multiple holes formed apart from each other in a circumferential direction of the tubular portion.

12. The damper device according to claim 10, wherein a damper stopper contactable with an outer peripheral edge of the damper device and an end portion of the damper device in an axial direction is attached to an inside of a cover member main body forming the cover member.

13. The damper device according to claim 1, wherein each of the first stay member and the second stay member includes a tubular portion formed in an annular shape, the tubular portion being provided with multiple holes formed apart from each other in a circumferential direction of the tubular portion.

14. The damper device according to claim 13, wherein a damper stopper contactable with an outer peripheral edge of the damper device and an end portion of the damper device in an axial direction is attached to an inside of a cover member main body forming the cover member.

15. The damper device according to claim 1, wherein a damper stopper contactable with an outer peripheral edge of the damper device and an end portion of the damper device in an axial direction is attached to an inside of a cover member main body forming the cover member.

* * * * *